US006303191B1

(12) United States Patent
Henne et al.

(10) Patent No.: US 6,303,191 B1
(45) Date of Patent: Oct. 16, 2001

(54) PROCESS FOR THE PRODUCTION OF A HEAT PIPE

(75) Inventors: Rudolf Henne, Boeblingen; Doerte Laing, Stuttgart; Heiko Thaler, Althuette-Waldenweiler, all of (DE)

(73) Assignee: Deutsches Zentrum Fuer Luft -und Raumfahrt e.V., Bonn (DE)

( * ) Notice: Subject to any disclaimer, the term of this patent is extended or adjusted under 35 U.S.C. 154(b) by 0 days.

(21) Appl. No.: 09/162,010

(22) Filed: Sep. 28, 1998

Related U.S. Application Data

(63) Continuation of application No. PCT/EP98/00308, filed on Jan. 21, 1998.

(30) Foreign Application Priority Data

Jan. 29, 1997 (DE) ..... 197 03 110
Apr. 24, 1997 (DE) ..... 197 17 235

(51) Int. Cl.[7] ..... C23C 4/02; C23C 4/12; F28D 15/04

(52) U.S. Cl. ..... 427/448; 427/446; 427/453; 427/454; 427/456; 427/455; 427/233; 427/236; 165/104.26; 29/890.032; 164/46; 264/309

(58) Field of Search ..... 427/446, 453, 427/455, 456, 233, 236, 448, 454; 165/104.26; 29/890.032; 164/46; 264/309

(56) References Cited

U.S. PATENT DOCUMENTS 4,093,755 * 6/1978 Dahl et al. ..... 427/299
4,177,328 12/1979 Rogers .
4,247,830 1/1981 Karras et al. ..... 331/94.5 D
5,285,046 * 2/1994 Hansz ..... 427/446

FOREIGN PATENT DOCUMENTS 1 950 439 4/1971 (DE) .
2 130 822 1/1973 (DE) .
21 49 883 8/1973 (DE) .
25 15 753 10/1976 (DE) .
27 17 752 11/1977 (DE) .
33 01 794 8/1983 (DE) .
0 415 231 3/1991 (EP) .
0 612 858 8/1994 (EP) .
2 286 229 8/1995 (GB) .

OTHER PUBLICATIONS

Dunn & Reay, "Heat Pipes," 1982, Pergamon Press, Oxford, pp. 142–148 and 146, line 2–146, line 5. (no month date).
*Patent Abstracts of Japan*, Abstract of Japanese Patent, "Heat Transfer Pipe", Published Sep. 13, 1982 as Publication No. 57148194, Application No. 56031239.
*Patent Abstracts of Japan*, Abstract of Japanese Patent, "Production of Heat–Transfer Tube of Multi–Tubular Evaporator and Finned Plate of Plate Evaporated", Published Sep. 9, 1988 as Publication No. 63216956, Application No. 62051002.
*Patent Abstracts of Japan*, Abstract of Japanese Patent, "Induction Plasma Device", Published Apr. 15, 1991 as Publication No. 03089498, Application No. 01227083.
English language abstract of DE 25 15 753, Aug. 4, 1983.

* cited by examiner

*Primary Examiner*—Katherine A. Bareford
(74) *Attorney, Agent, or Firm*—Barry R. Lipsitz; Ralph F. Hoppin

(57) ABSTRACT

In order to provide a heat pipe for transporting heat from an evaporation area to a condensation area, comprising a housing with housing walls, a capillary structure arranged in the housing and thermally coupled to the respective, corresponding housing wall in the evaporation area as well as in the condensation area, a vapor channel arranged in the housing and leading from the evaporation area to the condensation area as well as a heat transport medium, as well to make available a process for the production of such a heat pipe it is suggested that the capillary structure be an open-pored capillary layer produced by way of thermal plasma spraying of powder particles.

16 Claims, 7 Drawing Sheets

PROCESS FOR THE PRODUCTION OF A HEAT PIPE

This is a continuation of International Application PCT/EP98/00308, with an international filing date of Jan. 21, 1998.

BACKGROUND OF THE INVENTION

The invention relates to a heat pipe for transporting heat from an evaporation area to a condensation area, comprising a housing with housing walls, a capillary structure arranged in the housing and thermally coupled with the respective, corresponding housing wall in the evaporation area as well as in the condensation area, a vapor channel arranged in the housing and leading from the evaporation area to the condensation area as well as a heat transport medium.

Heat pipes of this type are known from the state of the art; with these, a structure produced from metallic netting, felts or woven wire mesh is customarily used as capillary structure, wherein the production is complicated and costly since a secure and close contact between the capillary structure and the walls of the heat pipe must be provided by a plurality of manual spot weldings.

Furthermore, the problem exists with these solutions that during long-term usage internal corrosion can occur as a result of the residual oxygen which is difficult to avoid or as a result of diffusion processes, primarily in the region of the points of contact altered in their structure due to the spot welding.

SUMMARY OF THE INVENTION

The object underlying the invention is therefore to provide a heat pipe with a capillary structure which is as simple to produce as possible and durable in use as well as to make available a process for the production of such a heat pipe.

This object is accomplished in accordance with the invention, in a heat pipe of the type described at the outset, in that the capillary structure is an open-pored capillary layer produced by way of thermal plasma spraying of powder particles.

The advantage of the inventive solution is to be seen in the fact that the thermal plasma spraying represents a simple possibility of producing open-pored capillary layers from powder particles quickly and with high power, wherein the porosity of the capillary layer may be set in a defined manner during the plasma spraying by way of suitable operational parameters.

The capillary layer can thereby be produced from the most varied of materials. One advantageous embodiment provides, for example, for the capillary layer to be produced from powder particles consisting of a metallic starting material, wherein not only pure metals but also any type of alloy may be used in this case. For example, refractory metal or nickel or nickel-based alloys can be used for high-temperature applications, preferably of more than 1000° Celsius, whereas brass, bronze or aluminum can be used, for example, in the room temperature range.

Alternatively thereto, it is preferably provided for the capillary layer to be produced from powder particles consisting of a ceramic starting material, wherein any type of ceramic material can be used.

An important limiting condition for all the materials for the production of the capillary layer is that these are inert in relation to the respective heat carrier medium.

A particularly advantageous structure of the capillary layer is present when this has powder particles bonded to one another as a result of surface melting and the molten layer thereby forming and extending over adjacent powder particles. This means that the powder particles are bonded to one another to form a rigid layer merely in that they are melted on their surface and bear a molten layer which extends at least over part of their surface and, on the other hand, sees to it that a type of partial "coating" results for adjacent powder particles with the molten layer of adjacent powder particles and this "coating" then holds the powder particles together in the capillary layer itself.

A particularly favorable concept provides for the powder particles in the capillary layer to each have beneath the molten layer a crystal structure which is unchanged in relation to the state prior to the plasma spraying. This solution has the great advantage that the crystal structure in the powder particles does not experience any alteration, with the exception of the molten layer, and thus the formation of undesired structures or bondings also does not occur and so capillary layers of this type have a long service life with, at the same time, a high mechanical stability.

Such a bond consisting of powder particles melted on their surface may be realized with powder particles having a homogeneous composition, wherein during the plasma spraying the extent or degree of melting of the particles can be defined by adjustment of the parameters.

It is, however, even more advantageous when the powder particles are built up as particles having a melting point varying over a diameter from the inside towards the outside, wherein the melting point preferably decreases from the inside towards the outside. In the simplest case, the particles are built up of a core and a shell or also designed as particles with several shells, for example, particles with two shells, wherein core and shell or the several shells are built up from materials with different melting points, preferably such that the melting point of an outer shell is lower than that of one of the inner shells or the core, wherein the melting points preferably decrease in steps from the inside towards the outside.

The possibility thus exists during the plasma spraying, for example, of melting only the outermost shell, the material of which is then available to ensure a stable bond between the individual particles whereas the core area remains unmelted and thus ensures the formation of the porous layer with the desired pore size.

Within the scope of the embodiments described thus far, the size of the powder particles has not been defined in greater detail. One particularly advantageous embodiment, for example, provides for powder particles to have a particle size of approximately 30 $\mu$m to approximately 300 $\mu$m. It is even more advantageous when the powder particles have a particle size of approximately 50 $\mu$m to approximately 200 $\mu$m.

Furthermore, the pore size has also not been defined in greater detail in conjunction with the preceding explanations concerning the individual embodiments. One advantageous embodiment, for example, provides for the capillary layer to have pores with an adjusted average size in the range of between approximately 10 $\mu$m and approximately 1000 $\mu$m. Even more advantageous is a formation of a capillary layer which has pores with an average size in the range of between approximately 50 $\mu$m to approximately 300 $\mu$m.

The pore size could, when an average pore size is maintained, be subject to considerable variations only for this average pore size.

It is, however, particularly advantageous, especially in order to obtain a definable effect of the capillary layer, when in a volume range the smallest value and the largest value of the pore size differ at the most by a factor of approximately two, i.e., for example, the smallest value is at the most approximately half the largest value.

In principle, it would be conceivable to apply the capillary layer directly to a substrate provided for this, for example a housing wall. For reasons of mechanical stability and good heat contact, a particularly expedient solution provides for an adhesive layer to be applied between the capillary layer and a substrate for this by way of plasma spraying.

Such an adhesive layer then offers particularly great advantages when this is produced from the same powder material as the capillary layer.

The adhesive layer itself does not need to be of a porous design. The adhesive layer is preferably designed as a continuous layer which has, in particular, a lower porosity than the capillary layer or even no porosity at all.

One advantageous solution provides for the adhesive layer to have a thickness of more than approximately 10 $\mu$m.

Powder particles with an average size in the range of between approximately 5 $\mu$m and approximately 50 $\mu$m are preferably used for the production of the adhesive layer by way of plasma spraying.

In order to improve the desired effect, in particular the transport effect, of the capillary layer in the heat pipe it is advantageously provided for the capillary layer to have a pore size changing in a predetermined direction, wherein the pore size can either change in steps or, even better, a continuous change is provided.

One possibility of using a varying pore size provides for the pore size in the condensation area to be larger than in the evaporation area and to become continuously smaller from the condensation area towards the evaporation area.

A further possibility of using a varying pore size provides for the pore size of the capillary layer to become smaller from a housing side in the direction of a vapor channel side in order to have, on the one hand, less flow losses on the housing side and to obtain a high capillary force on the vapor channel side of the capillary layer.

In principle, it would be possible, when using an adhesive layer, to apply the capillary layer directly to this with a defined average pore size. A particularly favorable solution does, however, provide for the capillary layer to have pores which become increasingly smaller proceeding from the adhesive layer. This means that with respect to its porosity the capillary layer has a gradient to ever smaller pores starting from the adhesive layer so that the largest pores of the capillary layer are located close to the adhesive layer and the finest pores in a region of the capillary layer facing the vapor channel.

With respect to the construction of the inventive heat pipes, no further details have been given in conjunction with the embodiments described thus far. One advantageous embodiment provides, for example, for the capillary layer to be part of an insert inserted into the housing of the heat pipe.

Such an insert may be produced outside the housing by way of plasma spraying and then inserted advantageously into the housing and connected to it.

An alternative solution for this provides for the housing comprising the capillary structure to be made up of at least two parts and for at least one of the parts to be provided with the capillary layer on an inner side, wherein in the simplest case this one part or both parts are coated on the inside.

Such a part may be produced in a particularly simple manner by direct coating of the part on the inner side with the capillary layer.

The parts are preferably connected to one another by joining, in particular welding.

In the case of coaxial heat pipes, it is preferably provided for the capillary layers respectively facing one another to be in capillary contact with one another via so-called arteries designed as a capillary structure. These arteries are preferably held on one of the capillary layers. In the simplest case, the arteries are produced from conventional, flexible net-like or felt-like materials suitable for capillary structures.

One embodiment which is adapted especially to the production techniques of the inventive solution provides, in addition, for the arteries to be integrally formed on one of the capillary layers facing one another and in the assembled state of the heat pipe to abut on the respectively other capillary layer with capillary contact.

The inventive object is also accomplished in accordance with the invention, in a process for the production of a heat pipe for transporting heat from an evaporation area to a condensation area, comprising a housing with housing walls, a capillary structure arranged in the housing and thermally coupled to the respective, corresponding housing wall in the evaporation area as well as in the condensation area, a vapor channel arranged in the housing and leading from the evaporation area to the condensation area as well as a heat transport medium, in that the capillary structure is produced as an open-pored capillary layer by way of thermal plasma spraying of powder particles.

The advantage of the production of the capillary structure in the form of an open-pored capillary layer by way of plasma spraying has already been explained in[]conjunction with the inventive heat pipe and so reference can be made in full to these comments.

In this respect, it is particularly expedient when the thermal plasma spraying is an HF plasma spraying. The advantage of the HF plasma spraying is to be seen, in particular, in the fact that an HF plasma torch operates without electrodes and so no contamination whatsoever can occur due to electrode burn-off. Furthermore, an HF plasma torch offers the advantage that a relatively voluminous plasma results due to the coupling in of high frequency and thus a large melting area is available in order to begin to melt, in particular, large particles as well, which is required with the inventive solution when an open-pored capillary layer is intended to be produced.

Furthermore, the HF plasma spraying has the advantage that the plasma flow velocity and also the powder particle velocity are low in comparison to the DC plasma spraying and so a relatively long holding time of the powder particles in the hot plasma area can be attained and this likewise has an advantageous effect during the melting of large particles.

In addition, the plasma spraying has, apart from the efficiency and speed, the great advantage that as a result of the adjustment of the individual parameters of the HF plasma torch a defined porosity of the capillary layer, in particular, a defined average pore size may be set.

A particularly favorable procedure provides for the plasma spraying to be carried out such that the powder particles are melted on their surface so that a molten surface extending over several powder particles is formed in the capillary layer and this holds the powder particles together in the solidified state.

In this respect, it is particularly favorable when the plasma spraying is carried out in such a manner that the powder particles have beneath the molten layer a crystal structure which corresponds to that of the powder particles prior to the plasma spraying.

Fundamentally, the HF plasma spraying offers the possibility of using powder particles with an essentially homogeneous material composition over their cross section since the extent of the surface melting of the powder particles may be set with suitable parameters.

The melting of the powder particles may, however, be predetermined even more advantageously when these are built up from a material with a melting point varying over the diameter, wherein the melting point preferably decreases from the inside towards the outside. In the simplest case, this may be realized with particles built up with several shells or several layers, wherein as a result of a step-like course of the melting point, preferably a step-like decrease in the melting point from the inside to the outside, the volume of the material to be melted and the volume of the unmelted core can be determined and so the pore size can also be determined.

With respect to the size of the powder particles for the plasma spraying, no further details have so far been given. In one advantageous solution, for example, those particles with an average particle size of between approximately 3 $\mu$m and approximately 300 $\mu$m are used as powder particles.

An average particle size of between approximately 50 $\mu$m and 200 $\mu$m is preferably used.

In conjunction with the embodiments explained thus far merely the production of a capillary layer as such has been specified.

Such a capillary layer could, for example, be applied directly to the substrate.

The plasma spraying used in any case for the production of the capillary layer makes it possible in a particularly simple manner to apply an adhesive layer by way of plasma spraying prior to application of the capillary layer to a substrate for this. Such an adhesive layer has the advantage that, on the one hand, a good mechanical contact results between the capillary layer and the substrate and, on the other hand, a good thermal contact as well and so a high mechanical and durable bond can be obtained between the capillary layer and the substrate.

The adhesive layer can, in principle, consist of a material which differs from the material of the capillary layer. A particularly favorable solution does, however, provide for the adhesive layer to be produced from the same powder material as the capillary layer.

Other requirements are also to be placed on the adhesive layer with respect to porosity. The adhesive layer can be designed as a porous layer but it need not necessarily be designed as a porous layer. It is, for example, particularly advantageous when the adhesive layer is produced, for example, as a continuous layer and thus forms an additional protective layer between the housing and the capillary layer and thus also protects the material of the housing against reactions with the heat transport medium which is of particular advantage when the heat pipes are used at high temperatures and, on the other hand, allows materials to be used for the housing which would not be usable with direct contact between housing and heat carrier medium, for example, on account of signs of corrosion or other chemical reactions.

In this respect, it is preferably provided for the adhesive layer to be produced with a thickness of more than approximately 10 $\mu$m.

With respect to the powder particles used for the application of the adhesive layer by way of plasma spraying, it is preferably provided for the adhesive layer to be produced from powder particles with an average size of between approximately 5 $\mu$m and approximately 50 $\mu$m.

The inventive process is particularly suitable for producing a capillary layer with an average pore size changing in a predetermined direction in order to improve the effect of the capillary layer in the heat pipe with it—as already described.

When using an adhesive layer it has proven to be advantageous when the capillary layer is produced with an average pore size becoming increasingly smaller proceeding from the adhesive layer and thus a gradient is produced within the capillary layer which cannot be produced more easily and efficiently with any process other than with plasma spraying since—as already explained—the pore size can be adjusted by way of variation of the operational parameters during the plasma spraying.

With respect to the production of the heat pipe itself, no further details have so far been given. One advantageous solution, for example, provides for the capillary layer to be produced as part of an insert and then inserted into the housing.

Such a capillary layer forming part of an insert may be produced, for example, in a simple manner in that the capillary layer is applied by way of plasma spraying to a molded member provided with mold release agent and then removed from this member after solidification for insertion into the housing. This means that a capillary layer representing a molded member can be produced in a simple manner by way of the thermal plasma spraying.

An alternative to the variation described above for the production of a heat pipe provides for the housing comprising the capillary structure to be made up of at least two parts, of which at least one is provided on its inner side with the capillary layer, in the simplest case coated on the inside. The two parts of the housing may be joined to one another to form a closed housing in a simple manner by means of any type of joining, for example, welding.

In conjunction with the process described thus far for the production of the heat pipes no details have been given as to how the vapor channels are produced. It is conceivable, for example, to design the capillary layer in the shape of a pipe so that it automatically encloses a vapor channel located in the interior of the pipe.

In the case of more complex constructional solutions, for example, in the case of coaxial heat pipes, the capillary layer is, however, preferably to be provided with at least one, preferably several vapor channels separately.

One advantageous embodiment, for example, provides for the capillary layer to be provided with a vapor channel by way of removal of parts thereof.

Alternatively thereto, it is, however, also conceivable to provide the capillary layer with a vapor channel by inserting a mask during the plasma spraying.

Another possibility provides for the capillary layer to be provided with a vapor channel as a result of spraying around an extractable member.

Additional features and advantages are the subject matter of the following description as well as the drawings illustrating several embodiments.

DETAILED DESCRIPTION OF THE INVENTION

Figure 1:
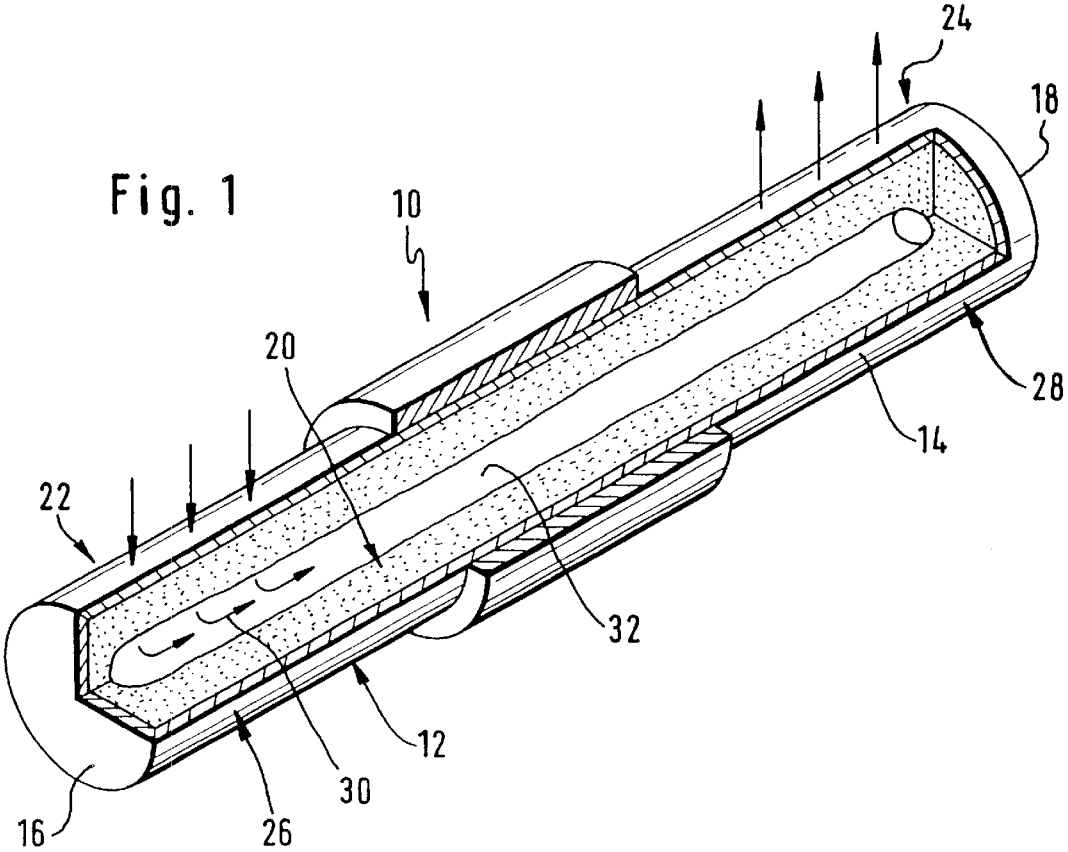
FIG. 1 shows the basic construction of a heat pipe broken open in longitudinal direction.

A heat pipe designated in FIG. 1 as a whole as 10 comprises a housing 12, for example, designed as an elongated cylinder with cylinder walls 14 and end walls 16 and 18. A capillary structure designated as a whole as 20 is provided in the closed housing 12 and this is connected at least in an evaporation area 22 and in a condensation area 24 to a corresponding housing area 26 and 28, respectively, with good heat contact.

The supply of heat to the housing area 26 surrounding the evaporation area 22 leads to evaporation of a heat carrier medium held by the capillary structure 20 in the evaporation area 22 by means of capillary force, thereby forming a flow of vapor 30 which flows in a vapor channel 32 enclosed by the capillary structure 20 to the condensation area 24 where it is condensed out again in the capillary structure 20 whilst transferring heat to the housing area 28 surrounding the condensation area 24. The capillary structure 20 is now in a position to transport the condensing heat carrier medium to the evaporation area 22 by means of capillary forces.

Figure 2:
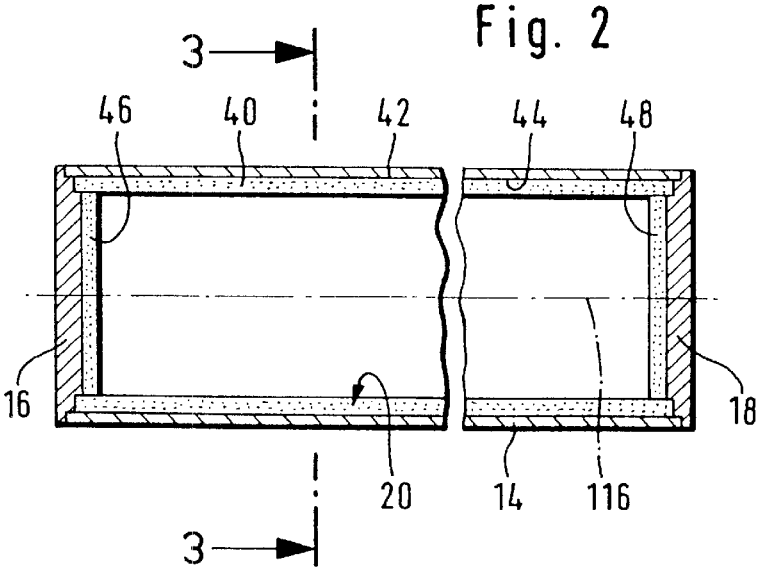
FIG. 2 shows a longitudinal section through a first embodiment of an inventive heat pipe.
Figure 3:
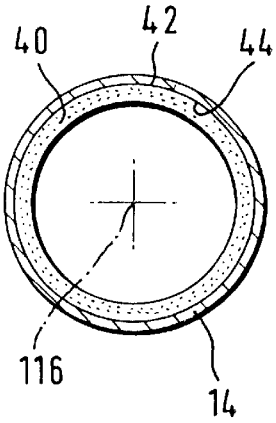
FIG. 3 shows a section along line 3-3 through the heat pipe according to FIG. 2.

In a first embodiment of the inventive heat pipe, illustrated in FIGS. 2 and 3, the capillary structure 20 is formed by an insert 40 which is inserted into the housing 12 in such a manner that an outer side 42 of the insert abuts on an inner side 44 of the cylinder walls 14 in heat contact.

Furthermore, the end walls 16 and 18 are likewise provided on their inner side with a capillary structure 46 and 48, respectively, which is in contact with the capillary structure 20 of the insert 14 when the end walls 16 and 18 are placed on the cylinder walls 14 at the ends so that a capillary effect is also provided with the insert 40 via the capillary structures 46 and 48.

Figure 4:
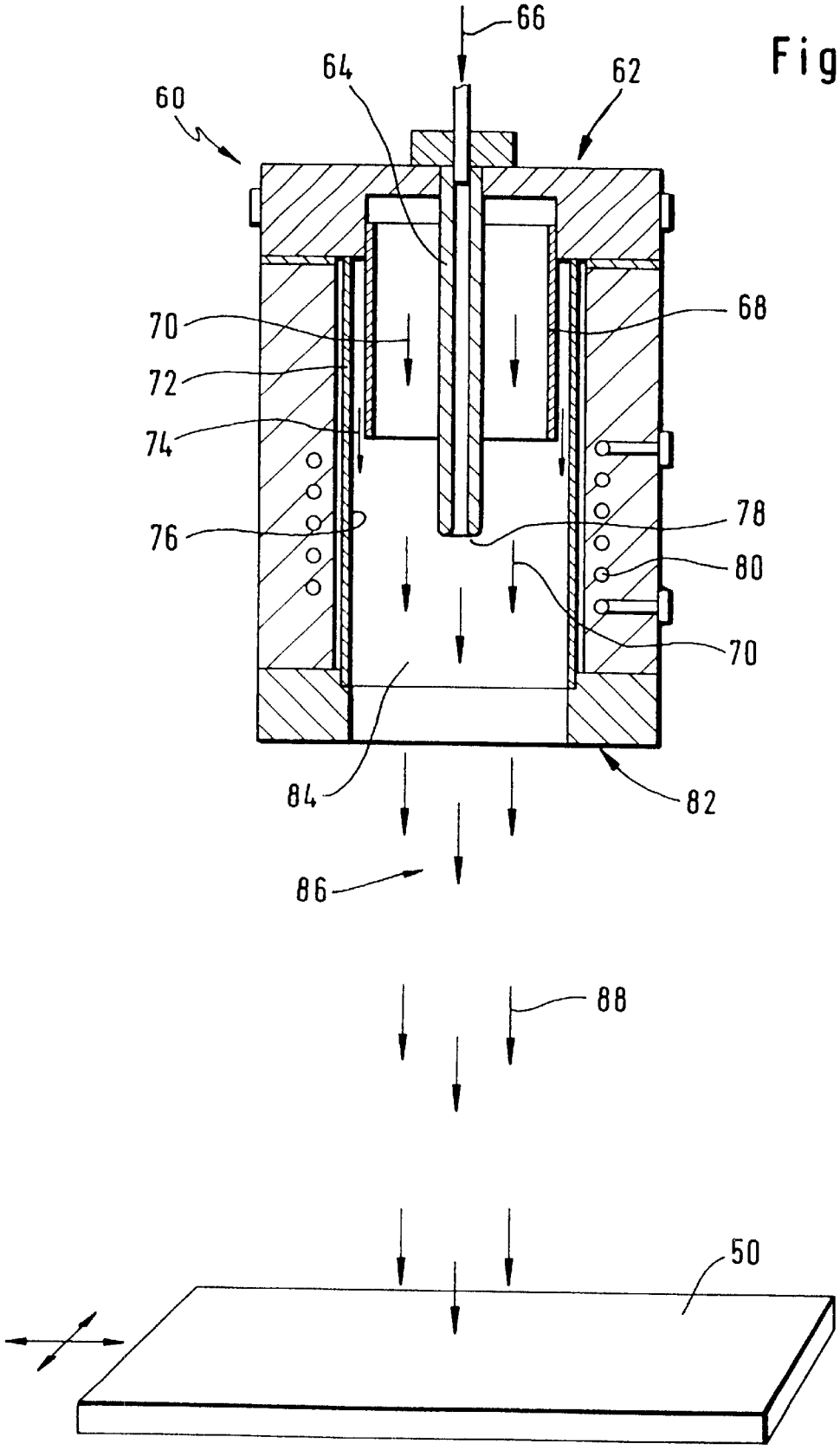
FIG. 4 shows a schematic illustration of the production of an inventive capillary layer by means of an HF plasma torch.

Not only the capillary structures of the insert 40 but also the capillary structures 46 and 48 are produced in the form of a capillary layer 50 by way of thermal high-frequency plasma spraying by means of a high-frequency plasma torch 60, illustrated in FIG. 4.

The high-frequency plasma torch 60 comprises a gas distributor head 62 which is penetrated by a powder supply tube 64. A stream 66 of powder particles and a carrier gas is supplied through the powder supply tube.

The powder supply tube 64 is surrounded by an intermediate tube 68 which is enclosed by the gas distributor head 62 and through which a flow 70 of central gas is supplied in order to form the plasma and to stabilize the discharge.

Furthermore, a flow 74 of protective gas is supplied between the intermediate tube 68 and an outer tube 72 and this cools an inner side 76 of the outer tube 72.

The outer tube 72 is, in addition, surrounded in the region of an opening 78 of the powder supply tube by an HF coil 80 which is connected to an HF generator. High frequency is coupled in by means of this HF coil 80 in order to generate a plasma cylinder in the region of the opening 78 of the powder supply tube 64, wherein energy is coupled in, on account of the skin effect in the flow 70 of the central gas for the formation of the plasma, only in on outer layer thereof on account of induced turbulences. The frequency, at which the HF coil 80 is fed, is thereby in the range of approximately 100 kHz to several MHz, wherein plasma temperatures of around 10,000 K are reached with customary geometry.

Downstream of the HF coil 80, an outlet nozzle 82 of the HF plasma torch 60 is provided and this is indicated only schematically and serves to carry out a pressure adjustment between a torch interior 84 surrounding the HF coil and a free-flow region 86 of a plasma jet 88 which is formed.

With such an HF plasma torch 60 relatively large particles may be melted without any electrodes, and thus avoiding impurities, wherein the relatively voluminous plasma in the torch interior 84 and the relatively long holding time of the particles in the hot plasma region benefits the melting of powder particles with a size of several 100 m.

Figure 5:
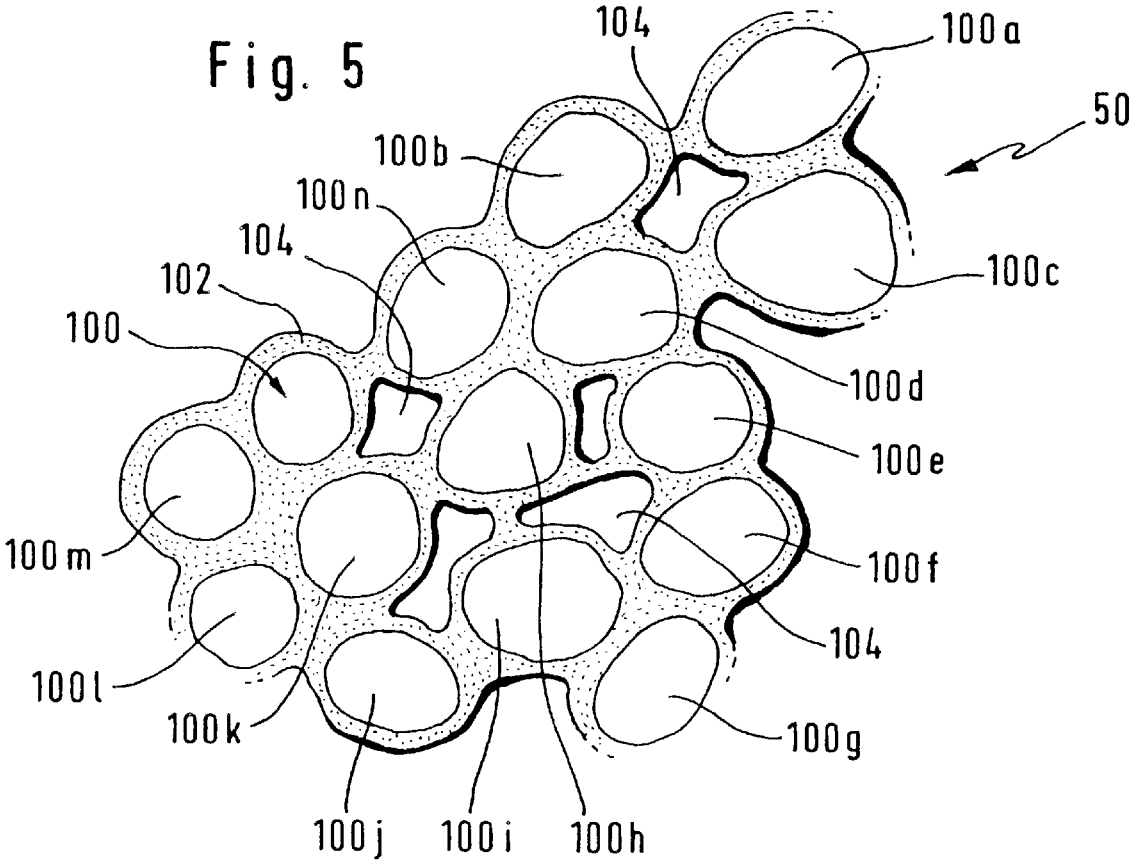
FIG. 5 shows a schematically illustrated microscopic structure in cross section through the capillary layer produced in accordance with the invention.

A capillary layer 50 produced with such an HF plasma torch 60 has, as illustrated in FIG. 5, a plurality of powder particles 100 which are covered with a molten layer 102, wherein the molten layer 102 surrounds the respective powder particles 100 at least in partial areas of their surfaces and, in addition, extends not over one powder particle 100 but at least over one additional, adjacent powder particle 100, as well, and thus forms an at least partial surface coating over the powder particles 100 which holds these together so that pores 104 preferably of a size varying by less than a factor of two are formed between the powder particles 100, partially covered by the molten layers 102, and thus, altogether, a capillary layer 50 results which has an open-pored structure and is thus in a position to serve as a capillary structure.

With the inventive, thermal HF plasma spraying it is possible in a particularly advantageous manner, on the one hand, to melt the powder particles on their surfaces and thus to provide the outer molten layer 102, which is in a position to join the powder particles 100 to one another in the capillary layer 50, from the same material, from which the powder particles 100 themselves are built up. On the other hand, the powder particles 100 themselves remain and have, with the exception of their molten layer 102, a crystal structure unchanged in comparison with prior to the plasma spraying.

Furthermore, the advantage with the thermal HF plasma spraying is to be seen in the fact that the molten layer 102 is in the molten state only in the millisecond range and then solidifies quickly in the capillary layer 50 itself on account of the cooling so that no risk whatsoever of any scaling exists. Furthermore, this also prevents the risk of chemical reactions and diffusions and thus the formation of disadvantageous phases and coarse structures.

Finally, the porosity may be adjusted as required for use via the size of the powder particles and the degree of the surface melting thereof.

The porosity and the capillary structure of the capillary layer may be adjusted, in particular, via the operational parameters of the torch, such as amount of central gas and composition thereof, HF power coupled in, pressure in the torch interior 84 of the HF plasma torch 60 and in the free-flow area 86 of the plasma jet 88, the distance between capillary layer 50 to be built up and the outlet nozzle and the size of the powder particles which are supplied with the flow 66.

Thus, capillary layers having a large area may be produced with a defined composition and uniform quality, on the one hand, quickly and, on the other hand, close to their final contour.

Figure 6:
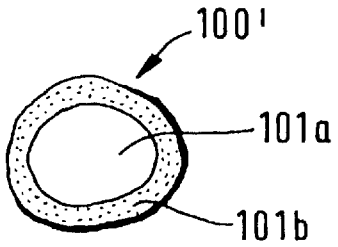
FIG. 6 shows a schematic illustration of a powder particle consisting of material having different melting points.
Figure 7:
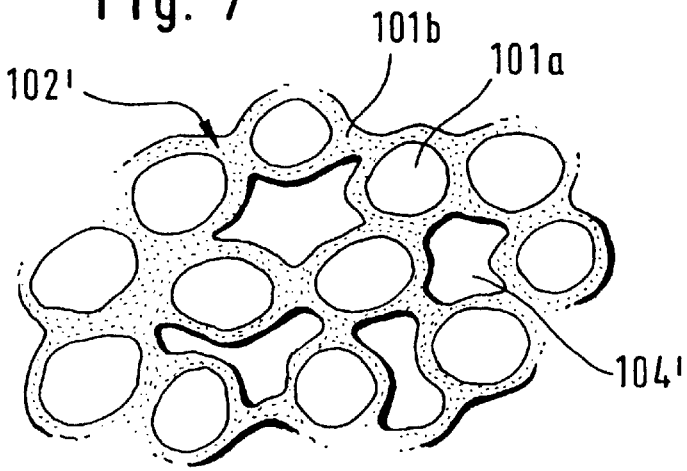
FIG. 7 shows a schematically illustrated, microscopic structure similar to FIG. 5 with use of powder particles according to FIG. 6.

An inventive capillary layer may be produced even more advantageously when the powder particles 100' are built up of a core 101*a* and a shell 101*b* (FIG. 6), wherein the shell 101*b* is of a material having a melting point lower than that of the core 101*a* so that the parameters during plasma spraying can be selected such that the material of the shell 101*b* is essentially melted and forms the molten layer 102', the material of the core 101*a,* however, remains unmelted and thus the size of the pores 104' of the capillary structure can be defined via the volume ratio of shell 101*b* to core 101*a* (FIG. 7).

Figure 8:
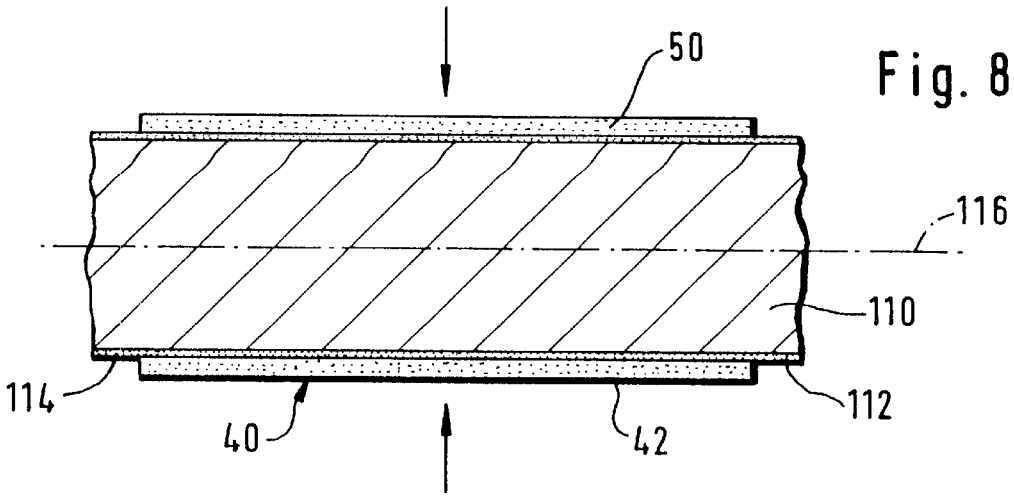
FIG. 8 shows a schematic illustration of the production of an insert comprising an inventive capillary layer.

For example, the production of the insert 40, as illustrated in FIG. 8, takes place by spraying the capillary layer 50 on a mandrel 110 with a cylindrical outer surface 112, to which a mold release agent 114 is applied.

The capillary layer 50 applied over the entire circumference of the mandrel 110 with approximately the same thickness thus forms a cylindrical member which can be removed from the mandrel 110 on account of the mold release agent 114 and can be inserted into the cylinder walls 14 as insert 40. For this purpose, the required dimension of the outer side 42 of the insert 40 is mainly determined by the thickness of the capillary layer applied and, where necessary, formed as a result of subsequent mechanical treatment such that the insert 40 abuts on the inner side 44 of the cylinder walls 14 with a good heat contact.

This may be achieved particularly advantageously when the outer side 42 of the insert 40 is of a conical design in relation to a cylinder axis 116 of the mandrel 110 and, on the other hand, as a countermove the inner side 44 of the cylinder walls 14 likewise so that when the insert 40 is inserted in the direction of the cylinder axis 116, which represents at the same time the axis of symmetry of the cylinder walls 14 as well, the outer side 42 abuts areally on the inner side 44.

Figure 9:
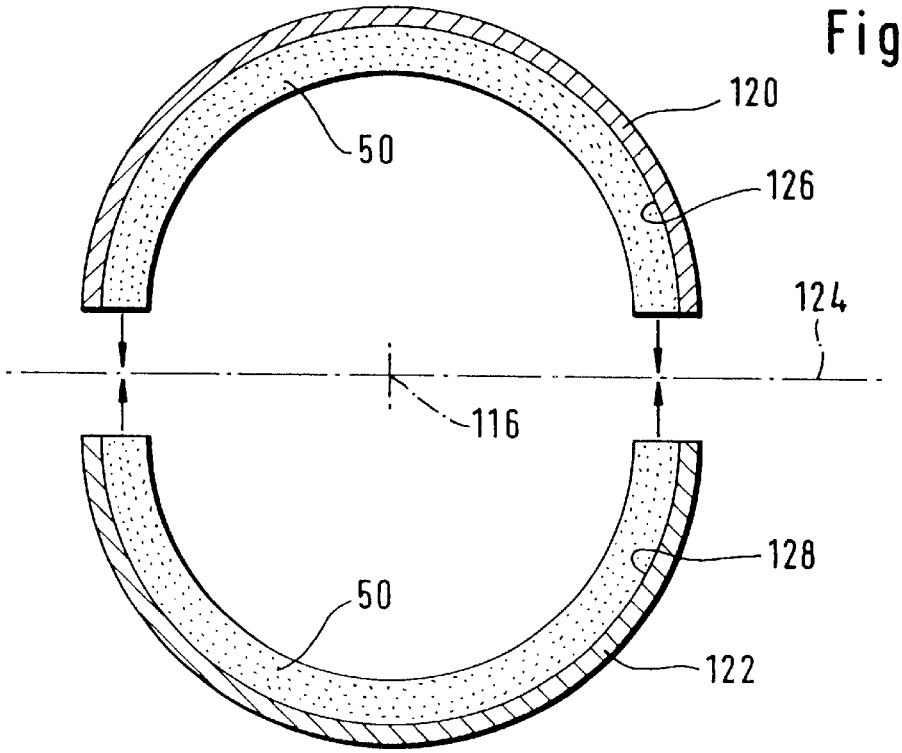
FIG. 9 shows a cross section through a second embodiment of an inventive heat pipe.

Alternatively to producing an insert 40 and inserting it into the housing 12, a heat pipe illustrated in FIG. 1 may also be produced in that, as illustrated in FIG. 9, the housing 12 is produced from two cylinder halves 120 and 122, wherein these cylinder halves 120 and 122 can be assembled such that a joining plane 124 is formed which extends through the longitudinal axis 116 of the housing.

These two cylinder halves 120 and 122 may be provided with the capillary layer 50 on their inner sides 126 and 128 in a simple manner by way of thermal HF plasma spraying prior to their assembly, thereby forming the joining plane 124. As illustrated in FIG. 9, the capillary layer 50 may be sprayed directly onto the inner sides 126 and 128 of the cylinder halves 120, 122.

Figure 10:
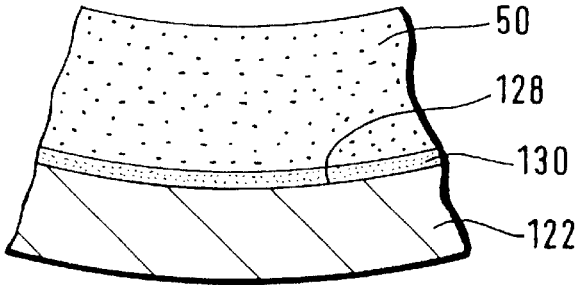
FIG. 10 shows an illustration of a variation of the second embodiment.

One advantageous variation of the second embodiment, as illustrated in FIG. 10, provides for an adhesive layer 130 to be applied first of all to the respective inner side, for example, the inner side 128, followed by the capillary layer 50.

The adhesive layer 130 preferably consists of the same material as the capillary layer but of powder particles of a smaller diameter, wherein for the application of the adhesive layer 130 the thermal HF plasma spraying is conducted such that the adhesive layer 130 has a lower or even no porosity at all, and covers the entire, respective inner side, for example, the inner side 128 of the housing half 122. The capillary layer 50 may then be applied to this adhesive layer in a simple manner by using a larger particle diameter and only surface melting of the particles and this capillary layer is held in a particularly firm manner on the adhesive layer 130; thus the adhesive layer 130 serves not only for fixing the capillary layer 50 in position on the respective inner side, for example, the inner side 12& but also for ensuring a good heat conduction between the capillary layer 50 and the respective housing.

Figure 11:
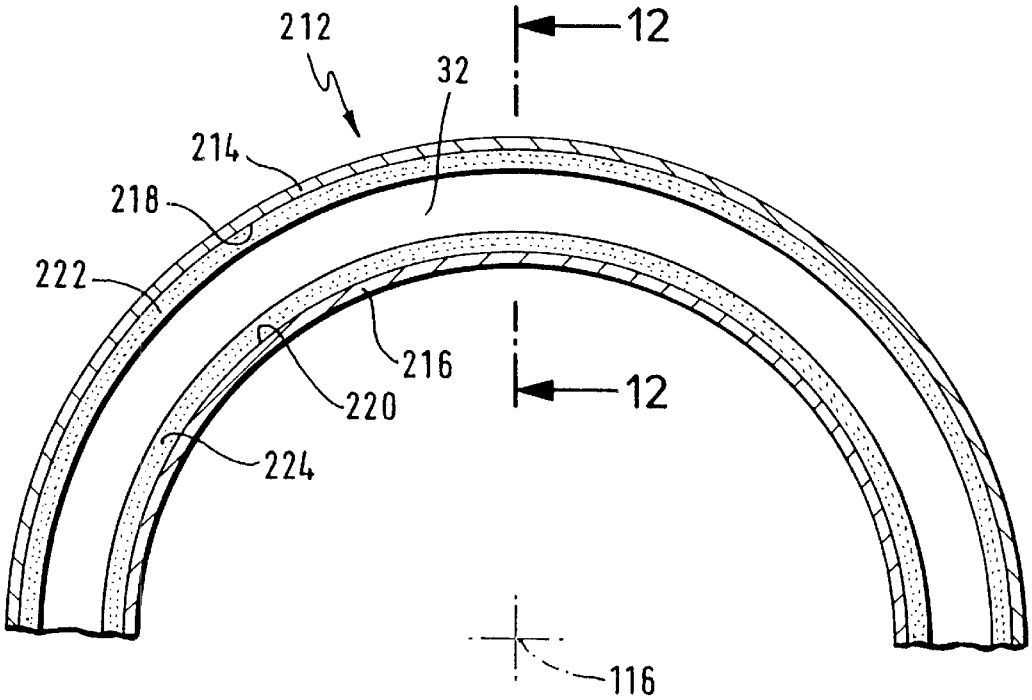
FIG. 11 shows a schematic illustration of a third embodiment of an inventive heat pipe in cross section.
Figure 12:
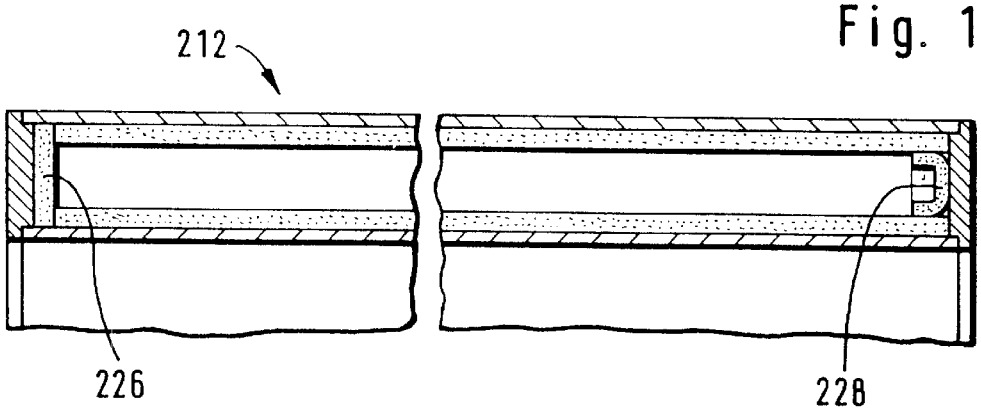
FIG. 12 shows a section along line 12—12 in FIG. 11.

A third embodiment, illustrated in FIGS. 11 and 12, relates to a coaxial heat pipe, with which the housing 212 is formed by two cylinder walls 214 and 216 which extend coaxially to one another and fit into one another as well as are closed at their ends, wherein each of the cylinder walls 214 and 216 is provided with a capillary structure 222 and 224, respectively, on its inner side 218 and 220, respectively, facing the vapor channel 32, wherein the vapor channel 32 is then located between the capillary structures.

The capillary layers 222 and 224 are then, for their part, joined in addition via annular, connecting capillary structures 226 or 228 extending radially to the cylinder axis 116, wherein the capillary structure 226 is formed by a capillary layer which is seated on an end discharge wall whereas the capillary structure 228 represents an element inserted in addition, consisting, for example, of a net material known per se, this element abutting on the respective capillary layers 222 and 224 and thus likewise ensuring a connection between them.

In the case of the third embodiment, as well, the inner sides 218 and 220 of the cylinder walls 214 and 216, respectively, are likewise preferably provided with the capillary layers 222 and 224, respectively, in that respective cylinder half shells are provided with the capillary layer by way of HF plasma spraying and this capillary layer is designed in the same way as that described in detail in conjunction with the first embodiment.

Figure 13:
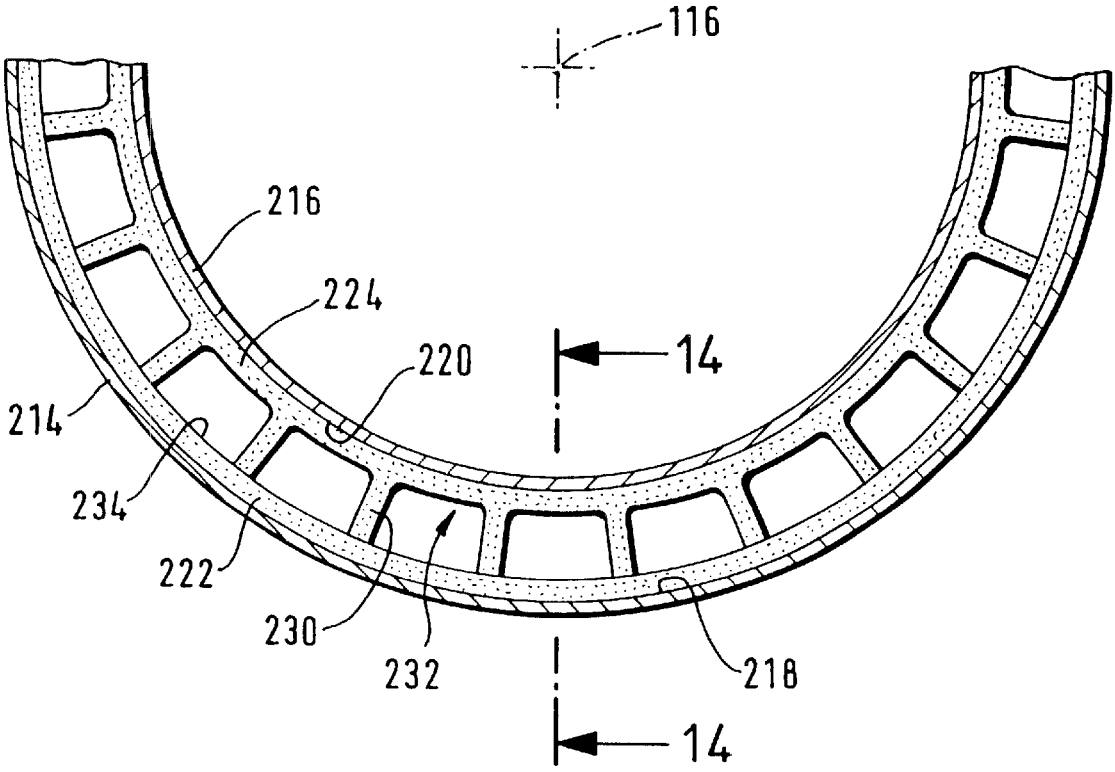
FIG. 13 shows a semilateral cross section through a fourth embodiment of an inventive heat pipe.
Figure 14:
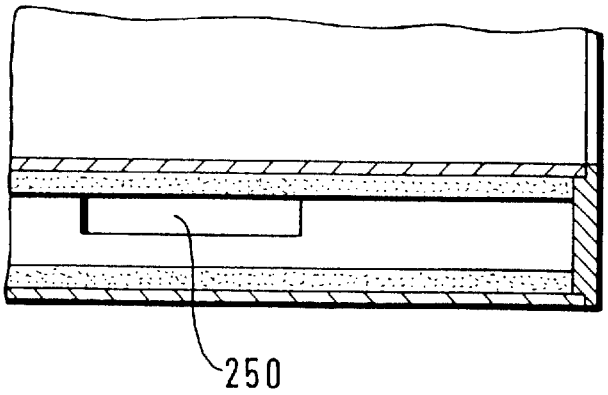
FIG. 14 shows a section along line 14—14 in FIG. 13.

In a fourth embodiment, illustrated in FIGS. 13 and 14, the heat pipe is likewise a coaxial heat pipe, wherein so-called arteries 230 are provided between the capillary structure 224 and the capillary structure 222, these arteries extending radially to the cylinder axis 116, acting as a capillary structure and, distributed over the entire circumference, joining the respective capillary layers 222 and 224 to one another.

In the fourth embodiment, the arteries 230 are designed, for example, such that they are integrally formed on the capillary layer 224.

Arteries 230 of this type may be produced, for example, in that a capillary layer 224 is first applied with a thickness which also comprises the radial extension of the arteries 230 and then grooves 232 are produced between the arteries due to local removal of material from the capillary layer 224 so that, on the one hand, the capillary layer 224 covering the inner side 220 remains and, on the other hand, the arteries 230 integrally formed thereon which then have, when the heat pipe is assembled, a radial extension such that they abut tangentially on an inner side 234 of the capillary layer 222 and a capillary contact exists between the arteries 230 and the capillary layer 222.

Figure 15:
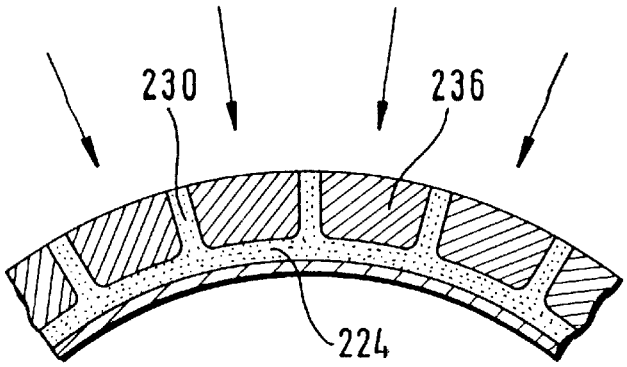
FIG. 15 shows a schematic illustration of a detail of a process for the production of the capillary layer with arteries of the fourth embodiment.

Alternatively thereto, as illustrated in FIG. 15, it is provided in a variation of the fourth embodiment for the capillary layer 224 to first be applied and then mask members 236 to be placed on this, between which spaces remain, in which the arteries 230 are then formed during continuation of the thermal HF plasma spraying. The mask members 236 may then be removed after the arteries 230 have been built up.

Such mask members 236 consist, for example, of graphite which may be thermally removed after completion of the arteries by way of thermal HF plasma spraying without altering the capillary layer and the arteries 230.

Figure 16:
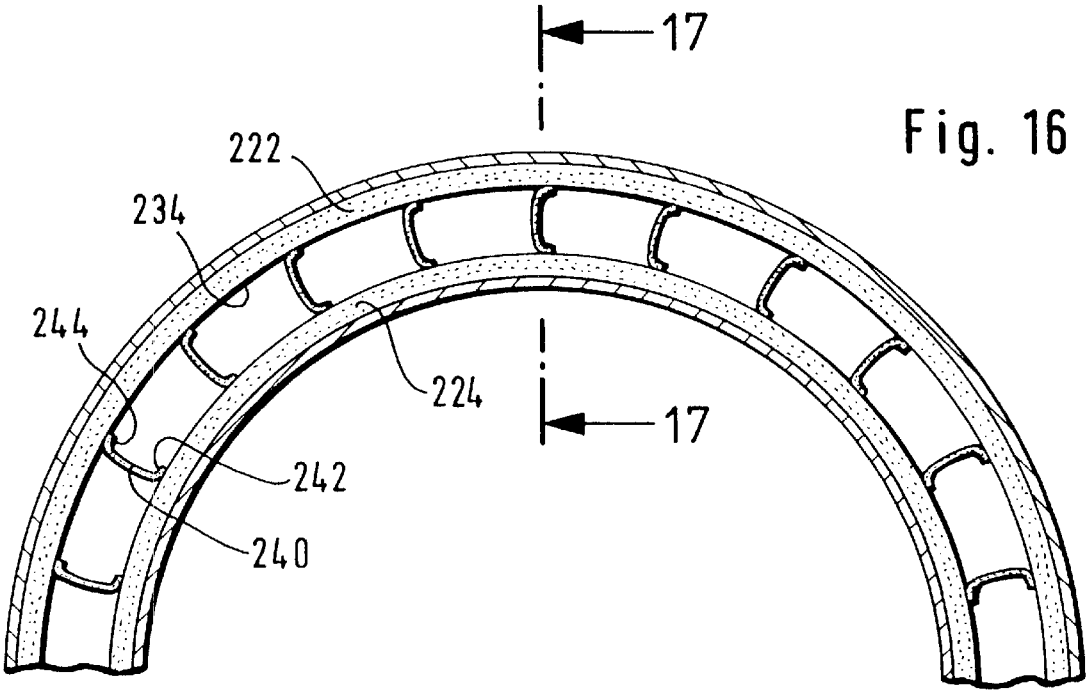
FIG. 16 shows a semilateral cross section through a fifth embodiment of an inventive heat pipe and FIG. 17 shows a section along line 17—17 in FIG. 16.
Figure 17:
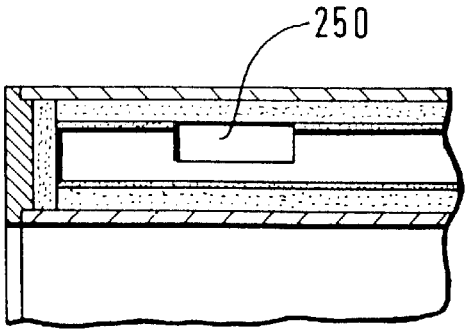

In a fifth embodiment, illustrated in FIGS. 16 and 17, arteries 240 are formed from several layers of net material which is normally used as capillary structure in heat pipes, wherein this net material is shaped each time like a C and, for example, joined to the capillary layer 224 with, for example, an arm 242. The connection to the capillary layer 224 takes place, for example, by way of spot welding in the region of the arm 242 of the corresponding artery 240. It is, however, also conceivable to embed the respective arm 242 of the respective artery 240 in the capillary layer 224 during the thermal HF plasma spraying and thus already anchor the respective artery 240 in the capillary layer 224 produced by way of thermal HF plasma spraying.

The other arm. 244 of the respective artery then abuts on the respective inner side 234 of the capillary layer 222 after assembly of the heat pipe such that capillary contact exists between the respective arm 244 and the capillary layer 222.

As for the rest, the fifth embodiment is designed in the same way as the third and fourth embodiments and so reference can be made to the comments on these embodiments with respect to the description of additional parts.

In both the fourth and the fifth embodiments the arteries are, as illustrated in FIGS. 14 and 17, provided in an azimuthal direction with respective openings 250 which thus allow an azimuthal flow of vapor and not only a flow of vapor in a radial direction in relation to the cylinder axis 116 or parallel to it.

What is claim is:

1. A process for the production of a heat pipe for transporting heat from an evaporation area to a condensation area, said heat pipe comprising a housing with housing walls, a capillary structure arranged in the housing and thermally coupled to a respective, corresponding housing wall in the evaporation area as well as in the condensation area, a vapor channel arranged in the housing and leading from the evaporation area to the condensation area, and a liquid heat transport medium contained in the housing, said process comprising the step of:

producing the capillary structure as an open-pored capillary layer by way of high frequency plasma spraying of powder particles onto a surface, wherein the high frequency plasma spraying is carried out such that the powder particles are melted on their surface but maintain a solid core beneath their surface to form a molten layer which solidifies and extends over said maintained solid cores in the capillary layer and joins the maintained solid cores of the powder particles in a solidified state.

2. A process as defined in claim 1, wherein the plasma spraying is carried out in such a manner that the powder particles have a crystalline structure beneath the molten layer corresponding to that of the powder particles prior to the plasma spraying.

3. A process as defined in claim 1, wherein the plasma spraying takes place with powder particles having a melting point that varies from the inside toward the outside of the powder particles.

4. A process as defined in claim 1, wherein powder particles having an average particle size of approximately 30 $\mu$m to approximately 300 $\mu$m are used.

5. A process as defined in claim 1, wherein prior to application of the capillary layer to a substrate, an adhesive layer is applied by plasma spraying.

6. A process as defined in claim 5, wherein the adhesive layer is produced from the same powder material as the capillary layer.

7. A process as defined in claim 5, wherein the adhesive layer is produced as a continuous layer.

8. A process as defined in claim 5, wherein the adhesive layer is produced with a thickness of more than 10 $\mu$m.

9. A process as defined in claim 5, wherein the adhesive layer is produced from powder particles with an average size of between approximately 5 $\mu$m and approximately 50 $\mu$m.

10. A process as defined in claim 1, wherein the capillary layer is produced with an average pore size that changes in a predetermined direction throughout the capillary layer.

11. A process as defined in claim 1, wherein the capillary layer is produced as part of an insert and is then inserted into the housing.

12. A process as defined in claim 11, wherein:

the capillary layer is applied to a molded member provided with a mold release agent, and the capillary layer is removed from the molded member for insertion into the housing.

13. A process as defined in claim 1, wherein:

the housing is made up of two parts, and at least one of said parts is provided with the capillary layer on its inner side.

14. A process as defined in claim 1, wherein the capillary layer is provided with a vapor channel by mechanically removing parts thereof.

15. A process as defined in claim 1, wherein the capillary layer is provided with a vapor channel by using a mask during the plasma spraying.

16. A process as defined in claim 1, wherein the capillary layer is provided with a vapor channel by using an extractable member during the plasma spraying.

* * * * *